US007281768B2

(12) United States Patent
Sato et al.

(10) Patent No.: US 7,281,768 B2
(45) Date of Patent: Oct. 16, 2007

(54) MANUFACTURING METHOD AND APPARATUS OF BRUSH

(75) Inventors: Hisao Sato, Sakata (JP); Kenichi Okabe, Sakata (JP); Shunji Kimura, Sakata (JP)

(73) Assignee: Kao Corporation, Tokyo (JP)

( * ) Notice: Subject to any disclaimer, the term of this patent is extended or adjusted under 35 U.S.C. 154(b) by 599 days.

(21) Appl. No.: 10/370,611

(22) Filed: Feb. 24, 2003

(65) Prior Publication Data

US 2003/0132661 A1 Jul. 17, 2003

Related U.S. Application Data

(63) Continuation of application No. PCT/JP01/07113, filed on Aug. 20, 2001.

(30) Foreign Application Priority Data

Aug. 23, 2000 (JP) ..... 2000-253178
Jul. 27, 2001 (JP) ..... 2001-228586

(51) Int. Cl.
*A46D 3/04* (2006.01)
*A46D 3/08* (2006.01)

(52) U.S. Cl. ..... 300/4; 300/2; 300/8; 300/21

(58) Field of Classification Search ..... 15/2, 15/4, 5, 8, 21; 264/243; 300/2–5, 8–9, 21
See application file for complete search history.

(56) References Cited

U.S. PATENT DOCUMENTS 2,876,477 A * 3/1959 Stewart ..... 15/167.1
4,255,224 A 3/1981 Lorenz
4,348,060 A 9/1982 Lewis, Jr.
4,619,485 A 10/1986 Lewis, Jr.
5,033,797 A 7/1991 Rueb
5,224,763 A 7/1993 Dirksing
5,344,218 A 9/1994 Weihrauch
5,464,275 A * 11/1995 Altemare et al. ..... 300/21

FOREIGN PATENT DOCUMENTS

EP 0 567 672 A1 11/1993
JP 54-152352 11/1979
JP 3-215211 9/1991
JP 4-226609 8/1992
JP 7-500044 1/1995
JP 7-502184 3/1995
JP 175744 * 6/2000

* cited by examiner

*Primary Examiner*—Randall Chin
(74) *Attorney, Agent, or Firm*—Oblon, Spivak, McClelland, Maier & Neustadt, P.C.

(57) ABSTRACT

A method of manufacturing a brush includes inserting bristles into bristles insertion holes, and implanting the bristles in a resin material. The inserting further includes preparing sleeves corresponding to cross sectional shapes and cross sectional areas of the bristles insertion holes; introducing the bristles into the sleeves; and independently inserting the bristles within each of the sleeves to the corresponding bristles insertion holes.

12 Claims, 15 Drawing Sheets

(A)

(B)

(C)

(A)

(B)

(A)

(B)

(C)

(A)

(B)

(A)

(B)

(A)

(B)

(A)

(B)

(A)

(B)

(A)

(B)

(A)

(B)

MANUFACTURING METHOD AND APPARATUS OF BRUSH

CROSS-REFERENCE TO RELATED AND PRIORITY APPLICATIONS

The present application is a continuation under 35 U.S.C. §365(c) of PCT/JP01/07113, filed Aug. 20, 2001, which in turn claims priority on JP 2000-253178 and JP 2001-228586, the entire contents of each of the above-noted applications hereby being incorporated herein by reference.

TECHNICAL FIELD

The present invention relates to a manufacturing method for a brush, such as a toothbrush or the like.

BACKGROUND ART

Previously, there has been widely performed a method of inserting bristles into bristles setting holes and fixing them by anchoring a metal plate. This method enables the brush to be simple. However, the following problems, among other problems, occur: the anchoring metal plate may become corroded; the anchoring metal plate has to be removed from plastic (the main part of a toothbrush) during disposal of the toothbrush; a thickness of a bristles implanting portion of a toothbrush cannot be reduced; bristles having large diameters cannot be implanted on the bristle implanting portion; and oblique implanting of bristles is difficult.

The following three methods do not use an anchoring metal plate:

(1) Type I: Japanese Patent Publication No. 6-16725, U.S. Pat. No. 4,635,313

The bristles are inserted into bristles insertion holes of a metal mold, and a plastic material is charged into roots of the bristles. Accordingly, a handle portion and bristles implanting portion of a toothbrush are manufactured. In this method, the plastic material tends to leak from the bristles insertion holes when charging the plastic material. In order to avoid the leakage, the roots of the bristles are fused to fill fine gaps in the bristles insertion holes. However, this is not sufficient to solve the leakage problem. When molding pressure is increased, the leakage still occurs.

(2) Type II: U.S. Pat. No. 5,458,400, Japanese Patent Application Laid-Open No. 9-182632

A toothbrush consisting of a brush head having perforated bristles setting holes and a recess, a brush neck, and brush handle is produced by injection molding from a suitable plastic material in a mold. Bristles are inserted into the perforated bristles setting holes and the ends of the bristles projecting from the back surface of the brush head are fused in an appropriate manner. The brush head portion is set in the mold to fill the brush head recess with a plastic material. In this method, leakage of the plastic material from the gap of the bristles setting holes is generated during the filling process, as in type I manufacturing mentioned above.

(3) Type III: Japanese Patent Publication No. 6-46962

The ends of the bristles are fused to form thick portions. A first surface of the head portion is also fused. The thick portions of the bristles are pressed against the fused surface of the head portion to fix the bristles to the head portion. In this method, quality control is difficult.

Recently, there is desired a toothbrush which is excellent for dental health, has good plaque removing characteristics, has excellent interdental cleaning characteristics, and is effective at massaging gums. In order to manufacture such a toothbrush, various creative efforts have been applied to the handle and the bristle implanting portion. The present invention relates to an improvement of the bristle implanting method.

Bristle performance depends upon the bristle implanting method, and recently various methods have been tried. Apart from the bristles implanting method, there are several factors to be considered for good performance of toothbrush. These factors include: a strength of the bristles, a size of the bristles, a thickness of the bristles, an area and a shape of the bristles setting holes, and the like. It is desirable that a single apparatus may manufacture various types of toothbrushes.

The following items can be listed as main factors of the bristles implanting method for a toothbrush.

(1) An angle of bristles against the brush head can be freely altered.

(2) A shape of bristles use ends can be optionally designed.

(3) A brush head can be made thin.

(4) No leakage of plastic material exists near bristles setting holes.

(5) Equipment of compact size and wide adaptability for production of several kinds of toothbrushes.

The present invention intends to manufacture a toothbrush satisfying the factors mentioned above without using an anchoring metal plate.

In a toothbrush without an anchoring metal plate, the oblique bristles implanting technique is difficult. A toothbrush having an inclined bristles is disclosed, for example, in WO99/23910A1, WO01/13762A1 and WO01/14117A1. The manufacturing method in these references falls within the method the type I described in the background art. In this method, in order to prevent a leakage of the charged plastic material from the bristles insertion hole; two methods are employed, i) increasing a charging density of the bristles, and ii) filling the bristles insertion hole with plastic material. Since the bristles implanting base portion of the toothbrush becomes exposed when used, the method ii) mentioned above is difficult to employ. Accordingly, the method i) mentioned above may be employed, however, in the case of using precut bristles, it is hard to insert the bristles into the bristles insertion hole at a high density.

Japanese Patent Application Laid-Open No. 9-182632 discloses that the bristles are inserted into the bristles insertion hole from a tapered holder by a bristles extrusion pin. However, all of the bristles are not inclined with respect to the implanted bristles base portion.

U.S. Pat. No. 4,693,519 and U.S. Pat. No. 4,255,224 disclose oblique implanting of bristles. However, these methods do not attain implanting with constant number and high density of bristles. Accordingly, in these methods a gap in the bristles insertion hole tends to be formed and the leakage problem is not resolved. Further, these methods do not include a method to change the shape of the use end of the bristles.

In order to pick up a constant number of the bristles into the bristles insertion hole and implant the bristles with a high density, it is well known to insert from a reel. Japanese Patent Application Laid-Open No. 7-194433 discloses a method of supplying the bristles from the reel, cutting the bristles to a suitable length, and thereafter increasing an implanting charging density of the bristles and forming the use end of the bristles. This method requires a compression apparatus and makes the equipment structure complex. Further, formation of the use end shape of the bristles is limited. It is possible to apply this method to oblique implanting of bristles. However, it is necessary to arrange a reel for supplying the bristles in an oblique direction. Accordingly, a direction of the implanting (a direction of the incline) is limited in view of contact and intersection between the reels and conveying paths of the bristles.

DISCLOSURE OF THE INVENTION

An object of the present invention is to freely set an implanting angle of bristles by a simple apparatus and to prevent the leakage of plastic material from bristles setting holes.

Another object of the present invention is to optionally form a shape of a use end of the bristles.

According to the present invention, there is provided a manufacturing method of a brush comprising: inserting bristles into a bristles insertion hole; and implanting the bristles in a resin material. The inserting further comprises preparing sleeves corresponding to cross sectional shapes and cross sectional areas of the bristles insertion holes; introducing the bristles to the sleeve; and independently inserting the bristles within the sleeve to the corresponding bristles insertion holes.

Further, according to the present invention, there is provided a manufacturing apparatus of a brush for inserting bristles into a bristles insertion hole and thereafter implanting the bristles in a resin material, comprising: sleeves independently prepared in correspondence to cross sectional shapes and cross sectional areas of the bristles insertion holes and configured to introduce the bristles; and an extruding means configured to independently insert the bristles within the sleeve to the corresponding bristles insertion holes, respectively.

In this case, "hole axis" means a direction along a longitudinal direction of the bristles at a time of holding the bristles in the holes. Further, "cross section of the hole" means a cross section by a surface perpendicular to a longitudinal direction of the bristles at a time of holding the bristles in the holes.

BRIEF DESCRIPTION OF THE DRAWINGS

FIGS. 3(A) to 3(C) are views showing a base plate having a bristles holding jig and a grip portion, in which FIG. 3(A) is a cross sectional view showing the bristles holding jig, FIG. 3(B) is a plan view of FIG. 3(A), and FIG. 3(C) is a plan view showing the base plate;

FIG. 4(A) is a cross sectional view showing a stack and a sleeve, and FIG. 4(B) is a perspective view showing the sleeve and an extrusion pin;

FIG. 5(A) is a cross sectional view showing a state in which the base plate is set to the bristles holding jig, FIG. 5(B) is a cross sectional view showing a bristles setting hole of the base plate, and FIG. 5(C) is a perspective view showing the base plate;

FIG. 6(A) is a cross sectional view showing the insertion of the bristles by a small diameter sleeve, and FIG. 6(B) is a cross sectional view showing the insertion of the bristles by a large diameter sleeve;

FIG. 8(A) is a cross sectional view showing an example of a round form, and FIG. 8(B) is a cross sectional view showing an example of a step formation;

FIG. 9(A) is a whole cross sectional view, and FIG. 9(B) is a cross sectional view of a main portion;

FIG. 10(A) is a whole cross sectional view, and FIG. 10(B) is a cross sectional view of a main portion;

FIG. 11(A) is a cross sectional view showing an insertion state of the bristles holding jig, and FIG. 11(B) is a cross sectional view showing a charged state;

FIG. 13(A) is a cross sectional view showing a bristles insertion state, and FIG. 13(B) is a cross sectional view showing a back surface charging state of the base plate;

FIG. 14(A) is a cross sectional view showing an example of a base plate having a grip portion, and FIG. 14(B) is a cross sectional view showing an example of a base plate having no grip portion;

FIG. 15(A) is a cross sectional view showing a bristles insertion state, and FIG. 15(B) is a cross sectional view showing a state in which the bristles insertion is completed; FIG. 16(A) is a cross sectional view showing a state in which the bristles base portion is fused to form thick parts, and FIG. 16(B) is a cross sectional view showing a state in which the cavity of the metal mold is charged with the resin.

BEST MODE FOR CARRYING OUT THE INVENTION

Figure 1:
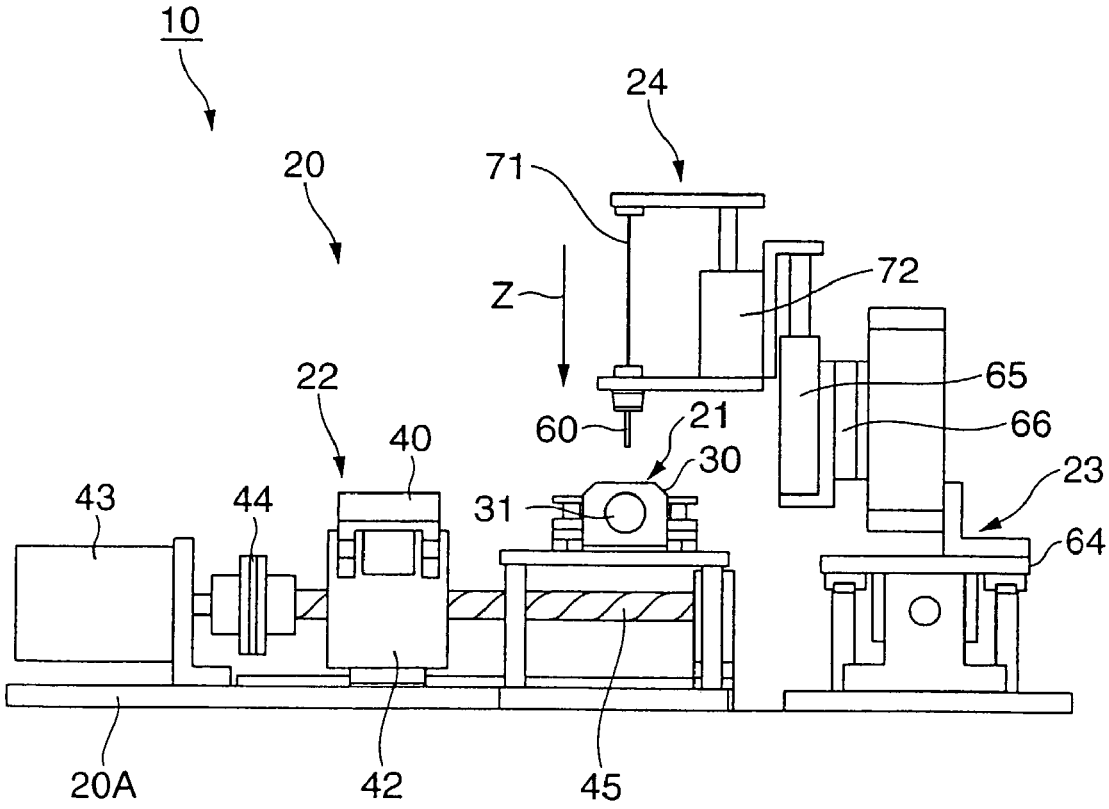
FIG. 1 is a front elevational view showing a toothbrush manufacturing apparatus.

A toothbrush manufacturing apparatus 10 is structured to insert bristles 1 into a bristles setting hole 4 of a base plate 3, and thereafter to charge a resin 5 into a back surface of the base plate 3 to manufacture a toothbrush 6 (see, e.g., FIGS. 1-3 and 11). The toothbrush manufacturing apparatus 10 comprises a base plate forming machine, a base plate transferring apparatus, a bristles inserting apparatus, a bristles base portion fusing apparatus, and a base plate back surface charging and forming machine.

Figure 2:
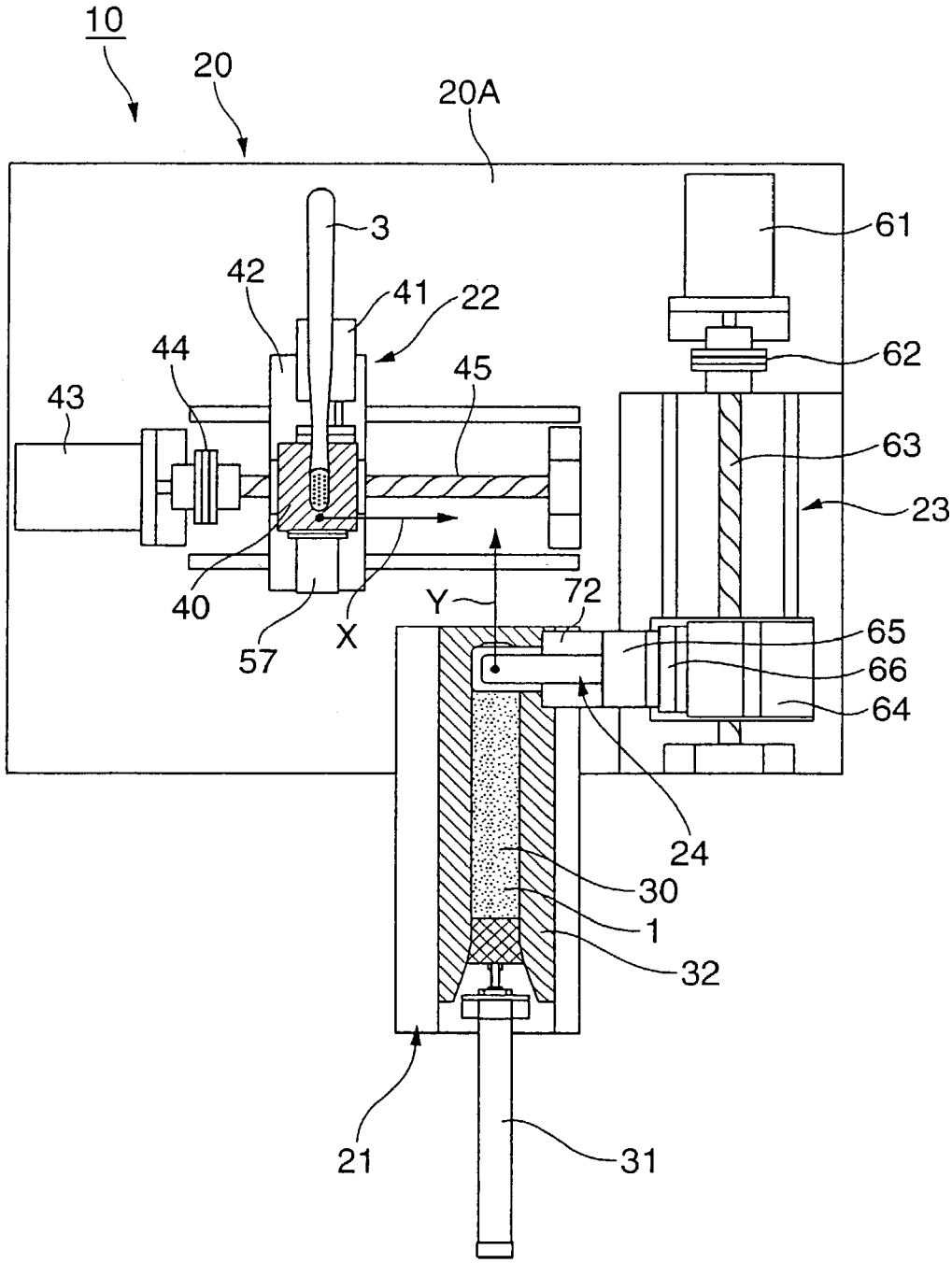
FIG. 2 is a plan view of FIG. 1.
Figure 3:
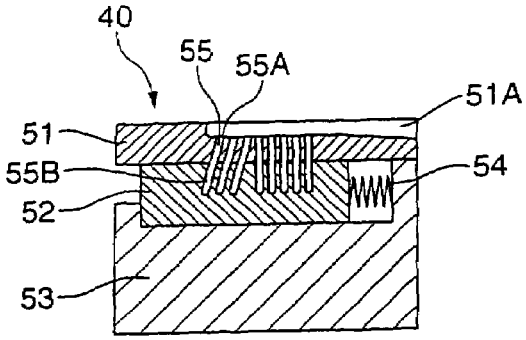
Figure 3:
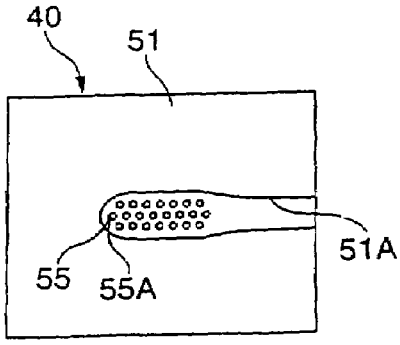
Figure 3:
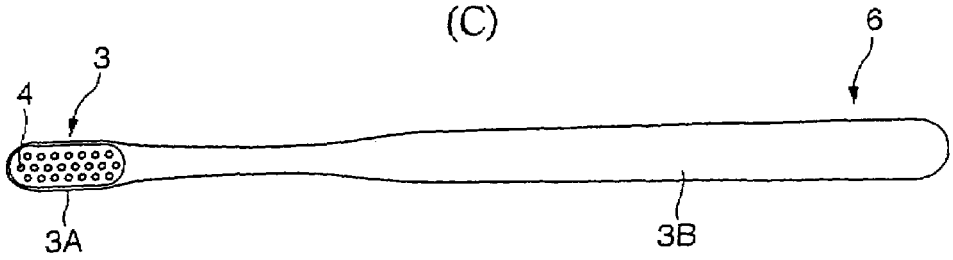

In the toothbrush manufacturing apparatus 10, a bristles inserting apparatus 20 is structured as shown in FIGS. 1 to 3, and includes the following on base 20A; a bristles supplying apparatus 21, a bristles holding jig moving apparatus 22, a sleeve holding and moving apparatus 23 and a bristles extruding apparatus 24, and operates in the following manner.

The bristles supplying apparatus 21 has a stack 30 for receiving an aggregation of bristles of a predetermined length. The stack 30 is pressurized by a pressurizing apparatus 31, and is pressure sealed in an inner portion of a guide 32 with a predetermined density. Accordingly, it is possible to stabilize an implanting density using a sleeve 60 mentioned below, and it is possible to prevent disorder of the bristles during the fusing-pressing of the bristles base portion and to prevent resin leakage from the gap of the bristles insertion hole while charging the back surface of the base plate 3 with resin.

The bristles holding jig moving apparatus 22 has a holding apparatus 41 for holding a bristles holding jig 40 (to which the base plate 3 is positioned and fixed). The bristles holding jig apparatus 22 is provided with this holding apparatus 41 in a transferring table 42. The bristles holding jig moving apparatus 22 transmits a turning force generated by servo motor 43 to the transferring table 42 from coupling 44 via a ball screw apparatus 45, thereby making it possible to move the transferring table 42 in the direction X corresponding to a horizontal direction along the guide rail. FIG. 2 shows a timing of inserting the bristles holding jig 40 into the holding apparatus 41. The bristles holding jig 40 is moved in the X direction for bristles implanting.

The bristles holding jig 40 (FIG. 3(A)) has an upper split body 51, a middle split body 52, a lower split body 53, and a spring 54. The upper split body 51 has a recess portion (or a convex portion) 51A for positioning and holding the base plate 3, and a bristles insertion hole 55 (55A) corresponding to the bristles setting hole 4 of the base plate 3. The middle split body 52 has a bristles insertion hole 55 (55B) connected to the bristles insertion hole 55 (55A) of the upper split body 51. The bristles insertion hole 55B is provided with a forming hole 56, which is described in detail later.

When the bristles holding jig 40 is fixed to the transferring table 42, a slide driving mechanism portion 57 slides the middle split body 52 in an intersection direction to a hole axis of the bristles insertion hole 55, and aligns the bristles insertion hole 55A of the upper split body 51 with a hole axis of the bristles insertion hole 55B in the middle split body 52. When the bristles 2 are inserted into the bristles insertion holes 55 (55A and 55B) of the bristles holding jig 40, the slide driving mechanism portion is released, and the spring 54 slides the middle split body 52 to an original position so as to fix the bristles 2, thereby holding the bristles 2 in the following stages of transferring, fusing-pressing, and charging.

The sleeve holding and moving apparatus 23 holds the sleeve 60 and moves in the Y direction (corresponding to a horizontal direction) and a Z direction (corresponding to a vertical direction). The turning force of the servo motor 61 is transmitted to a horizontal moving table 64 from a coupling 62 via a roll screw apparatus 63, and the horizontal moving table 64 is moved in the Y direction along the guide rail. The horizontal moving table 64 mounts an elevating apparatus 65 holding the sleeve 60 thereon, the elevating apparatus 65 moves in the Z direction, and the movement in the Z direction makes the sleeve 60 catch the bristles and move close to the base plate 3 for implanting the bristles into the base plate 3. In this case, if sleeve revolving apparatus 66 is provided between the mechanisms for supporting the sleeve 60, it is possible to control an angle of the sleeve 60. FIG. 2 shows the timing of catching the bristles using the sleeve 60. The sleeve 60 is moved to the Y direction for implanting the bristles to the base plate 3.

Figure 8:
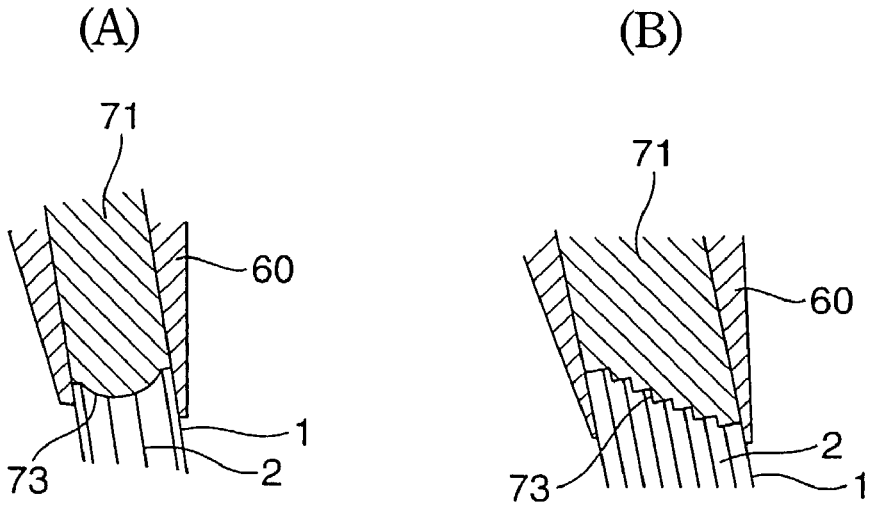
FIGS. 8(A) and 8(B) are views showing a step of forming a use end of the bristles.

The bristles extruding apparatus 24 includes a driving apparatus 72 for an extrusion pin 71 on the elevating apparatus 65. The extrusion pin 71 extrudes the bristles 2 in the sleeve 60 to the bristle setting hole 4 of the base plate 3. The extrusion pin 71 is provided with a forming end 73 mentioned below (see, e.g., FIGS. 6 and 8).

Accordingly, the bristles inserting apparatus 20 is provided with the following structural characteristics.

(1) Holding the base plate 3 in the bristles holding jig 40.

(2) Catching the bristles 1 in the stack 30 for stocking the bristles 1 by sleeve 60, which moves to the Z direction.

(3) Having the bristles holding jig moving apparatus 22 and the sleeve holding and moving apparatus 23 for positioning the base plate 3 and the sleeve 60 at the X and the Y directions during the bristles implanting step.

(4) Pushing the bristles in the sleeve 60 and implanting them into the base plate 3 and the bristles holding jig 40 with the extrusion pin 71.

(5) Forming a shape of the use end portion of the bristles 2 when inserting the bristles using the forming hole 56 provided in the use end of the bristles insertion hole 55 and the forming end 73 provided in the use end of the extrusion pin 71 at a time of inserting the bristles into the bristles holding jig 40. At least a portion of the use end of the bristles is formed in a shape other than flat.

(6) Continuous implanting to all of the base plate 3 and the bristles holding jig 40.

(7) Holding the bristles 2 with the upper split body 51 and the middle split body 52 after implanting to the bristles holding jig 40 to prevent disorder of the bristles after removal from the bristles holding jig 40.

In this case, the bristles inserting apparatus 20 can employ the following modifications:

(1) The base plate 3 (the bristles holding jig 40) is fixed and an XYZ three axis moving mechanism is provided in the sleeve 60.

(2) Each of the driving mechanisms can employ a servo motor, an air linear motor, a combination of a motor and a rack gear, a cam mechanism, and the like.

(3) The sleeve 60 can employ a sleeve exchanging mechanism.

(4) Various shapes of the use end of the bristles 2 may be included, other than those specifically described in this embodiment.

(5) The pressurizing apparatus 31 of the stack 30 can employ a system of applying a physical load, a system of extruding the bristles by various gears or the like, in addition to the air drive.

(6) The slide mechanism for the upper split body 51 and the lower split body 52 of the bristles holding jig 40 may also be split into three parts, as an alternative to two parts.

(7) It is possible to effectively implant the bristles to a part of the metal mold by using a guide plate (100) the same shape as the bristles setting holes of the base plate or the same sloped shape without using the base plate 3, as mentioned later.

A description will be given below of a manufacturing procedure of the toothbrush by the toothbrush manufacturing apparatus 10. Introducing step of the bristles into sleeve (FIG. 4) includes:

(1) Filling the stack 30 with the bristles 1 made of a resin, for example, a polyamide such as a nylon or the like, a polyester such as a polybutylene terephthalate, or the like.

Figure 4:
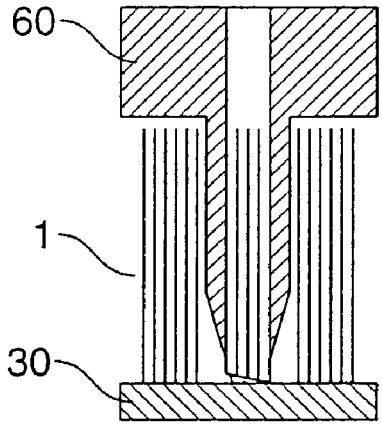
FIGS. 4(A) and 4(B) are views showing a step of catching a certain amount of the bristles.
Figure 4:
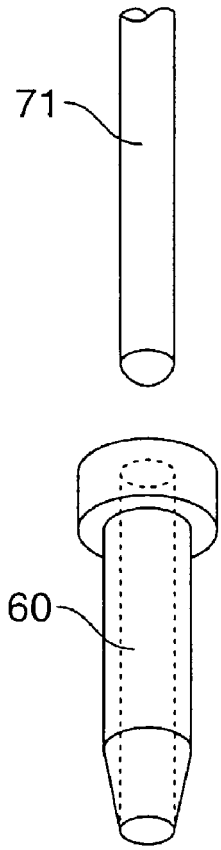

(2) Sticking the sleeve 60 into the bristles stack 30, and introducing a predetermined amount of bristles 2 to the sleeve 60 (FIG. 4).

(3) The individual sleeves 60 are prepared in corresponding to the cross sectional shapes and the cross sectional areas of a plurality of bristles insertion holes 55 provided in the bristles holding jig 40.

(4) In order to reduce resistance applied to the sleeve 60 at a time of inserting the sleeve 60 to the bristles stack 30 and to prevent bending of the bristles, a thickness of the top end of the sleeve 60 is made small, and a thickness in the bottom end is set to a predetermined thickness for securing a strength of the sleeve 60.

In particular, in production of the toothbrush, in view of both of an insertion property and a durability of the sleeve 60, a preferable thickness of the top end is about 0.1 mm to 0.3 mm, and that of the bottom end is 0.3 mm to 0.8 mm. It is possible to further improve the insertion property by rounding or beveling an outer periphery of an edge portion of the top end of the sleeve 60 about R0.1 mm to R0.2 mm. If various coatings (for example, a polytetrafluoroethylene, or the like) are applied to inner and outer surfaces of the sleeve 60, a slip property of the sleeve 60 is improved. A material of the sleeve 60 can be selected based on convenience, durability, or the like (for example, selecting a hardened metal having a high hardness to increase a durability of the top end of the sleeve 60).

It is effective that the top end surface of the sleeve 60 is formed in an oblique cut shape for the purpose of reducing the resistance at a time of inserting to the stack 30 and improving an oblique implanting procedure.

Figure 5:
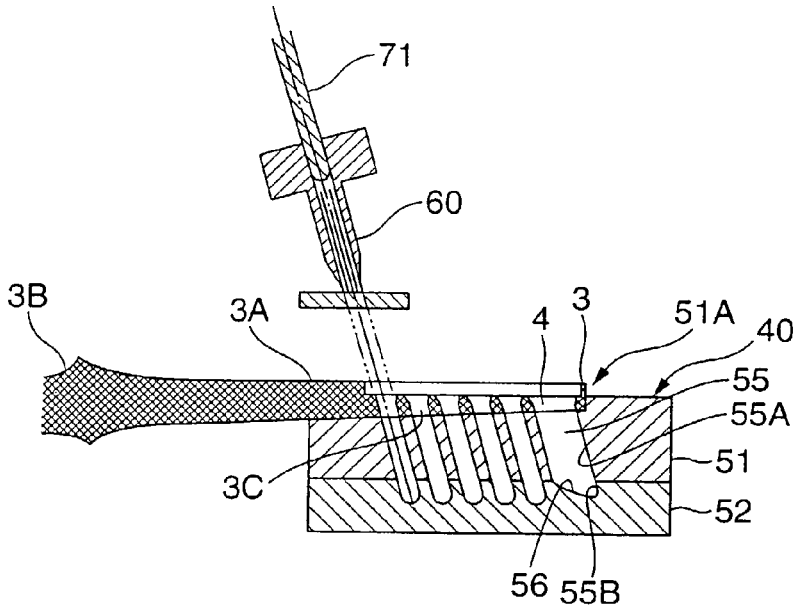
FIGS. 5(A) to 5(C) are views showing a step of preparing for insertion of the bristles.
Figure 5:
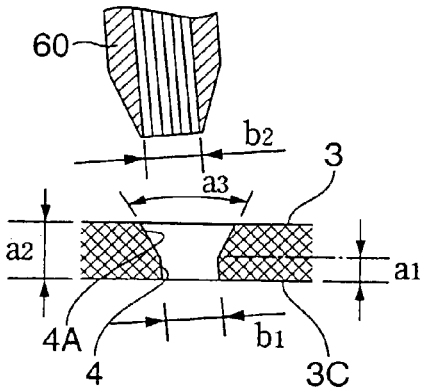
Figure 5:
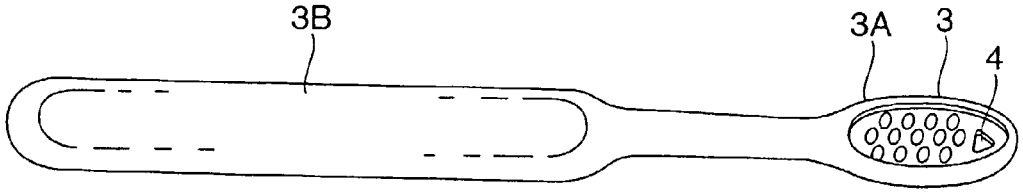

Pre-step of bristles insertion (FIG. 5) includes:

(1) The base plate 3 is formed from a resin (for example polypropylene) (FIG. 5). In this example, a head portion 3A and a grip portion 3B are formed in one injection step, and the head portion 3A has a lot of perforated bristles setting holes 4. The bristles setting holes 4 have a wide opening part in a back surface of the base plate 3.

(2) The base plate 3 is positioned and held in the recess portion 51A of the bristles holding jig 40, and the bristles setting holes 4 of the base plate 3 and the bristles insertion hole 55 of the bristles holding jig 40 are in a communication state. The bristles insertion hole 55 of the bristles holding jig 40 may be obliquely intersected in addition to being vertically intersected to the implanting surface 3C of the base plate 3. Only a part of the bristles may be obliquely intersected, or all may be obliquely intersected.

(3) A bristles implanting preparation state is achieved by inserting the extrusion pin 71 to the sleeve 60 which holds the bristles 2. In this case, if suction is applied to the bottom of the sleeve 60, it is possible to securely hold the bristles 2, and it is possible to prevent the bristles 2 from dropping off during a transferring process.

The bristles inserting step (FIGS. 6 to 8) includes:

(1) The bristles 2 in the sleeve 60 are inserted into the corresponding bristles setting hole 4 of the base plate 3 and the bristles insertion hole 55 of the bristles holding jig 40 by the extrusion pin 71. A wide opening portion 4A is provided in the bristles setting hole 4 of the base plate 3 (see, e.g., FIG. 5(B)). The slope of the wide opening portion 4A enables smooth moving of bristles 2 toward the bristles setting holes 4 and a density of the implanted bristles can be increased. The higher implant density has higher effect for preventing of leakage of plastic material from the bristles setting holes. However, if the density is too high, it becomes difficult to implant the bristles.

(2) As shown in FIG. 5(B), a preferred thickness a2 of base plate 3 is 1 mm to 5 mm, a preferred length a1 of bristles setting holes is 0.5 mm to 2 mm, a preferred angle a3 of the slope of the wide opening portion 4A is 20 degrees to 120 degrees, a preferred ratio of the diameter b1 of bristles setting holes 4 to the diameter b2 of sleeve 60 (b2/b1) is 80% to 130%. These figures are selected in consideration of an implanting smoothness of the bristles, as well as to avoid leakage while improving an outer appearance of the toothbrush. Further, a hole diameter of the bristles insertion hole 55 in the bristles holding jig 40 is basically the same diameter as a hole diameter of the bristles setting hole 4 in the base plate 3. However, it is preferable that the hole diameter of the bristles insertion hole 55 is 0.05 mm to 0.2 mm larger than the diameter of the bristles 2 with respect to the implanting smoothness of the bristles 2.

Figure 6:
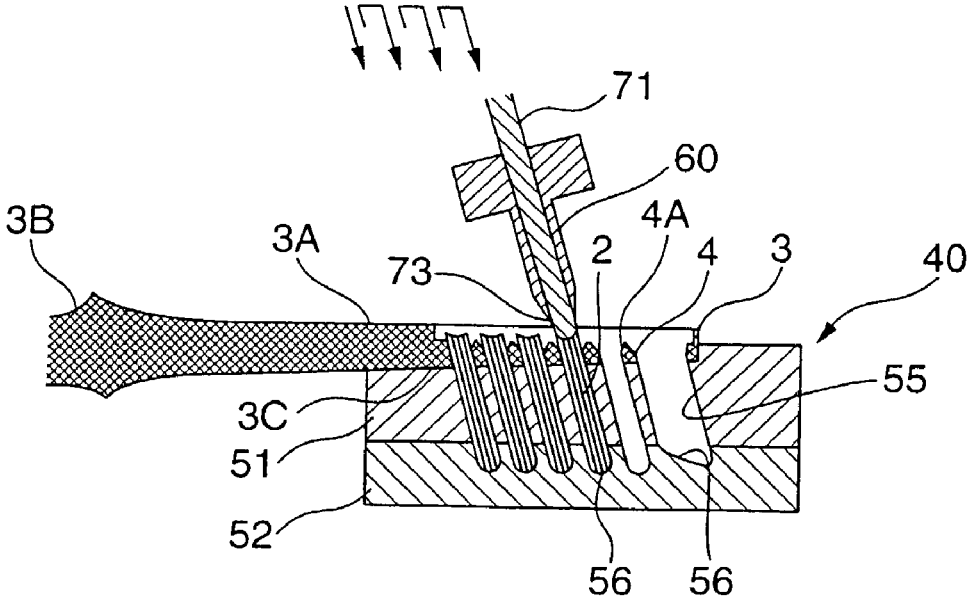
FIGS. 6(A) and 6(B) are views showing a step of inserting the bristles.
Figure 6:
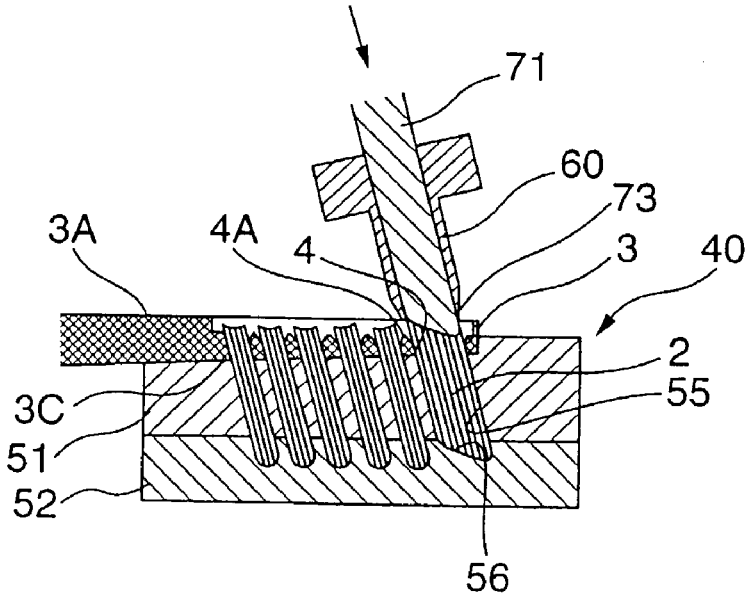
Figure 7:
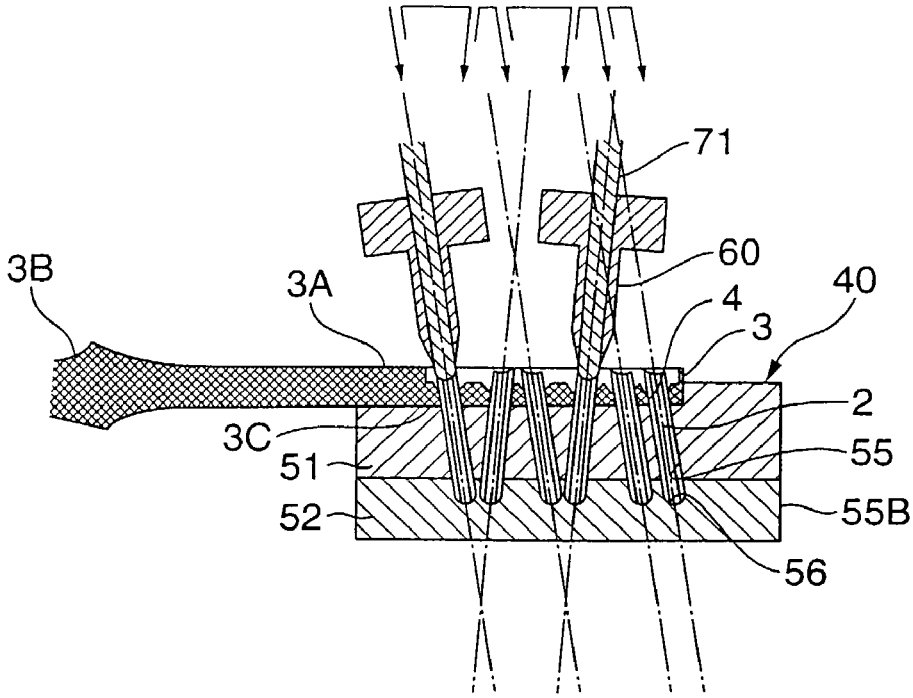
FIG. 7 is a cross sectional view showing a bristles insertion state into a plurality of bristles insertion holes having different hole axial directions.

(3) Since the sleeve 60 is individually prepared in correspondence to the cross sectional shape and the cross sectional area of the bristles setting hole 4 of the base plate 3 and the bristles insertion hole 55 of the bristles holding jig 40, the sleeve 60 is changed when the bristles setting hole 4 and the bristles insertion hole 55 have different cross sectional aspect (FIG. 6). Since a predetermined length of the bristles 2 is sequentially introduced to the sleeve 60, the sleeves 60 do not interfere with each other during the bristles implanting process, and this procedure enables an oblique implanting of the bristles in an optional oblique direction (FIG. 7). (Japanese Patent Application Laid-Open No, 9-182632 discloses a simultaneous implanting of the bristles to plural bristles setting holes. However this method does not enable optional oblique implanting without interference of each extrusion pin of the bristles.)

(4) When inserting the bristles 2 into the bristles insertion hole 55 of the bristles holding jig 40, the use end portion of the bristles 2 is stereoscopically formed based on an end shape of the forming hole 56 and an end shape of the extrusion pin 71.

In the case of forming a right angle with the sleeve 60 and the extrusion pin 71, and forming a round surface or the like at the end of the extrusion pin 71 (FIG. 8(A)), it is possible to prevent the bristles 1 from catching in a clearance between the sleeve 60 and the extrusion pin. In particular, it becomes advantageous to have a round shape or a tapered shape of the use end of the bristles 1.

In the case of a step shape (FIG. 8(B)), since the forming end 73 has a press contact surface in the same direction as the use end of the individual bristle 1, it is possible to attain accurate movement of the bristles 1 toward the longitudinal direction within the sleeve 60, and it is possible to prevent the bristles 1 from becoming disordered at a time of extrusion. It is advantageous to have oblique shaped use ends of the bristles 2 when the insertion direction is oblique.

It is preferable that the forming hole 56 (FIG. 7) of the bristles insertion hole 55 in the bristles holding jig 40 is provided near the split surface of the middle split body 55B.

(5) The bristles holding jig 40 can be constructed by a resin material in addition to a metal material. In particular, in the case of constructing by polytetrafluoroethylene or the like, the material has a good slip property and insertion of bristles into the jig 40 is improved. In consideration of the slip property and the durability of the jig 40, it is effective that main body of the jig 40 is composed by a metal material and an inner surface of the jig 40 is coated by the polytetrafluoroethylene.

Figure 9:
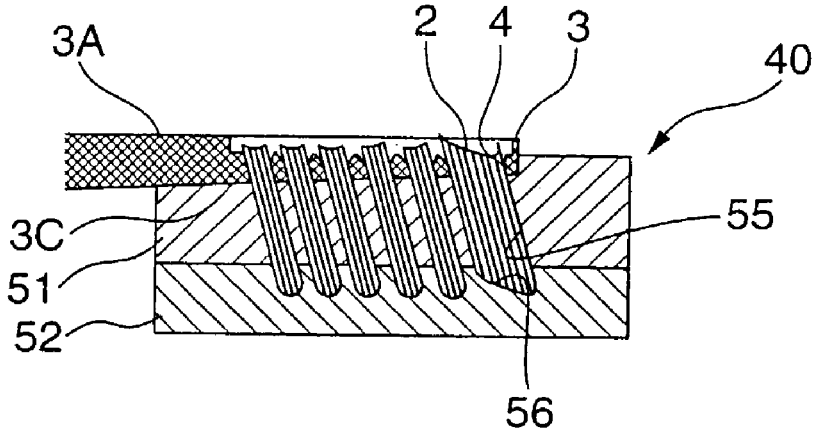
FIGS. 9(A) and 9(B) are views showing a state in which the insertion of the bristles are completed.
Figure 9:
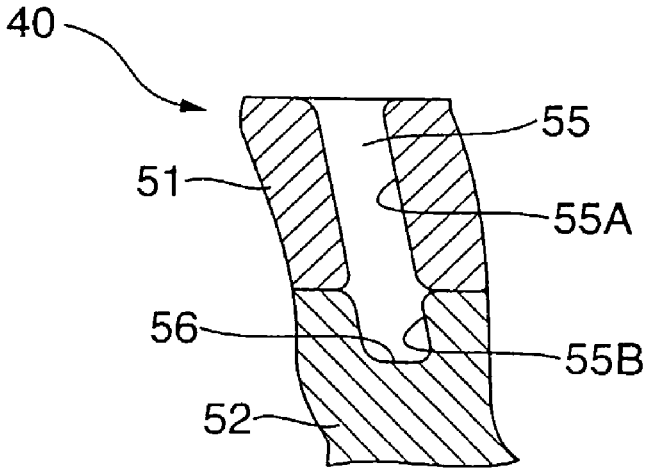

The sliding and holding step of bristles (FIG. 9) includes:

(1) When the insertion of the bristles 2 into the bristles insertion hole 55 of the bristles holding jig 40 is completed (FIG. 9), the middle split body 52 of the bristles holding jig 40 is slid in a direction intersecting to the hole axis of the bristles insertion hole 55 with respect to the upper split body 51, thereby holding the bristles 2. The bristles holding jig 40 can improve the holding effect of the bristles 2 by being separated into three splits or more, rather than being separated into two splits. If separated into two splits, the bristles holding jig 40 includes the upper split body 51 and the middle split body 52. In this slide, a relative moving distance between the upper split body 51 and the middle split body 52 is about 0.1 mm to 1 mm, and the moving distance is selected according to the state of bristles holding.

(2) By holding the bristles 2 in the bristles holding jig 40 according to (1) mentioned above, it is possible to prevent disorder of the bristles (e.g., floating up and twisting) in the transferring step and to prevent the bristles from twisting during a fusing and pressing process to the bristles base portion (in particular, in the case of using ultrasonic vibration, the bristles tend to float up and twist due to vibration. It is also possible to prevent the bristles from twisting when exposed to charging pressure during the charging of the resin 5 to the back surface (FIG. 11(B)).

The fusing step of bristles base portion (FIG. 10) includes:

(1) The bristles 2 implanted in the bristles setting holes 4 cannot be removed from the bristles setting holes 4 by fusing the base portion of the bristles 2.

The end surfaces of the base portions of the respective bristles 2 are integrated by fusing and pressing the end surfaces of the base portions using a heating body 81 of fusing apparatus 80 and a plate-like block 2A which covers the surface of the bristles setting hole 4 of the base plate 3 is formed (FIG. 10(B)). The charged resin 5 does not leak from the bristles setting hole 4 during a charging process because of the plate-like block 2A (FIG. 11(B)) (the method of the present invention is advantageous to a system of inserting the bristles into the metal mold in view of leakage prevention).

Figure 10:
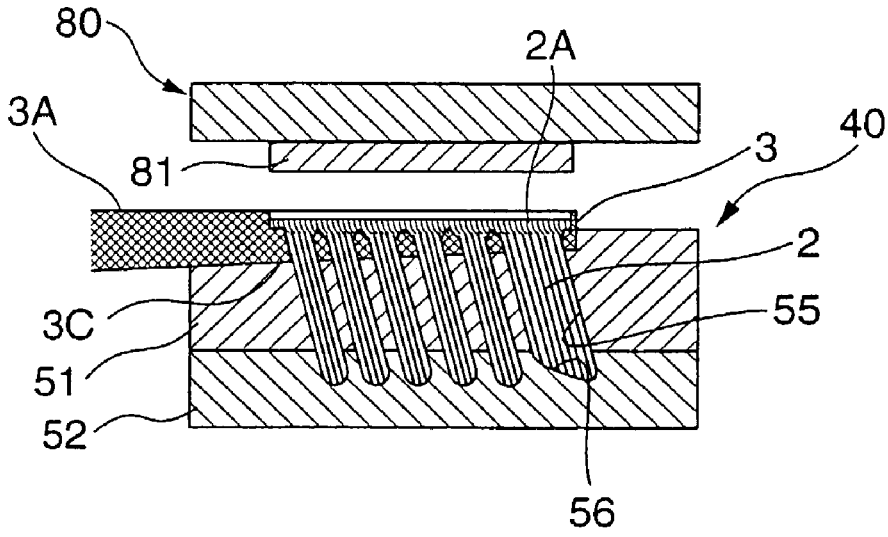
FIGS. 10(A) and 10(B) are views showing a step of fusing the base portion of the bristles.
Figure 10:
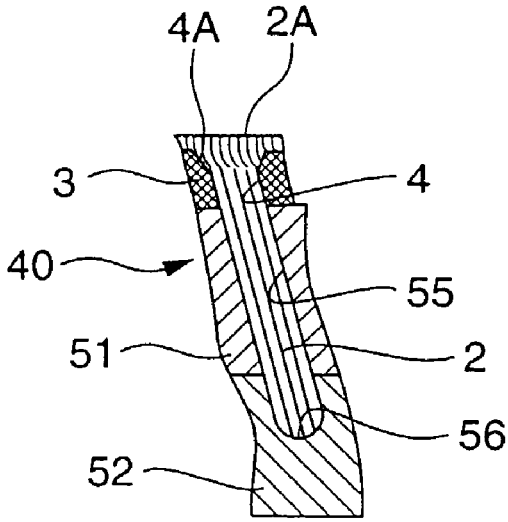
Figure 11:
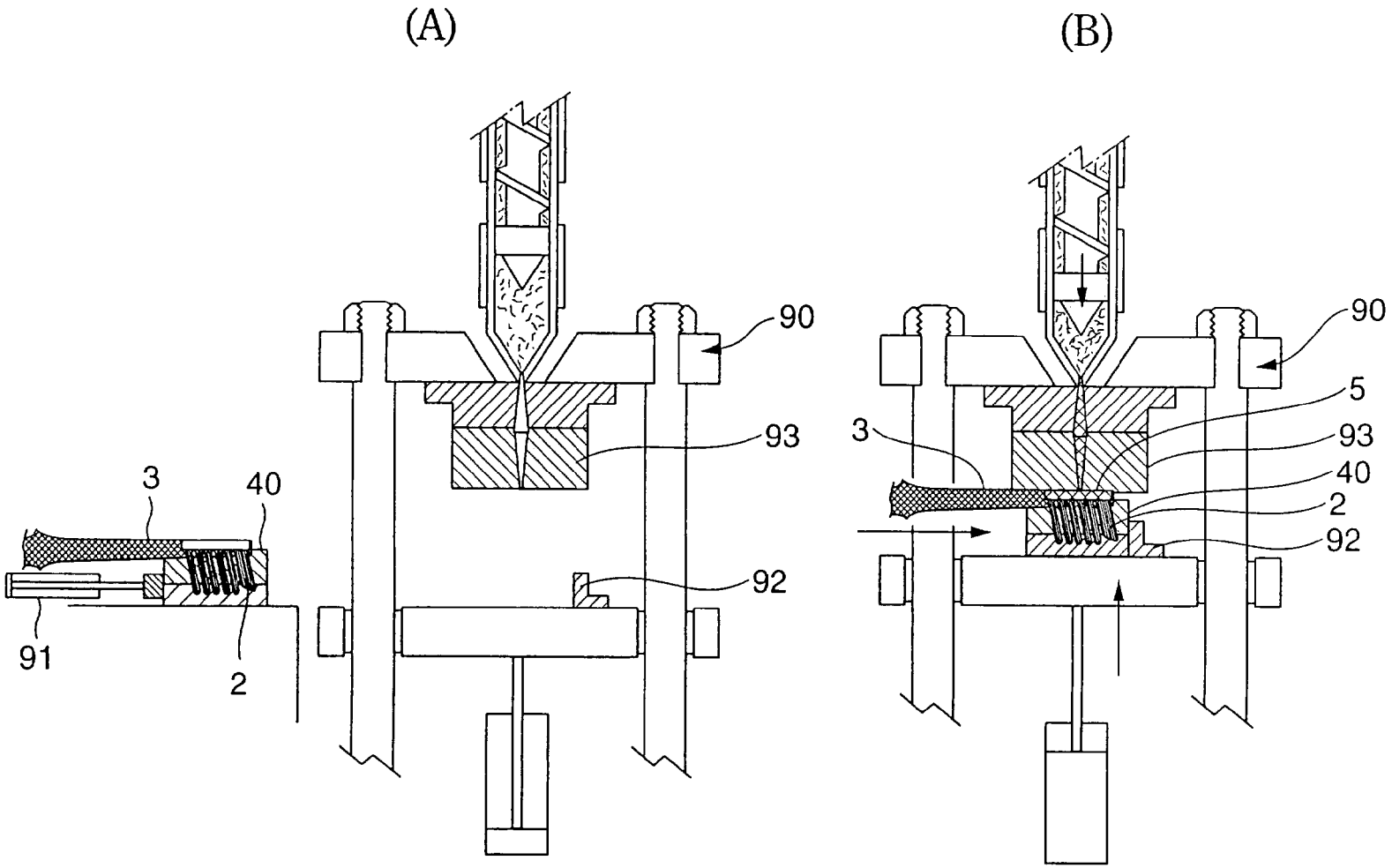
FIGS. 11(A) and 11(B) are views showing a step of charging a resin into the back surface of the base plate.
Figure 16:
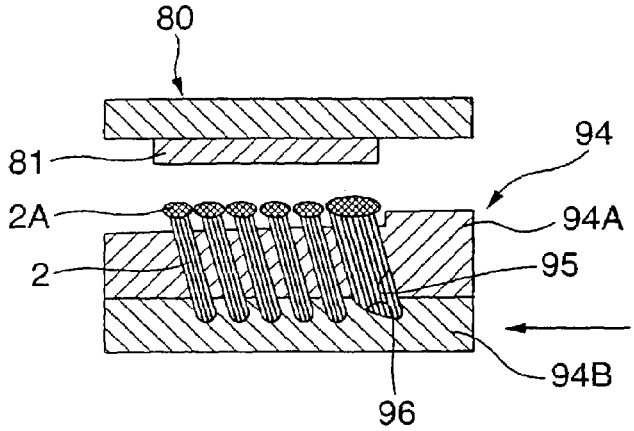
FIGS. 16(A) and 16(B) are views showing steps of fusing the base portion of the bristles and charging a cavity of a metal mold with a resin.
Figure 16:
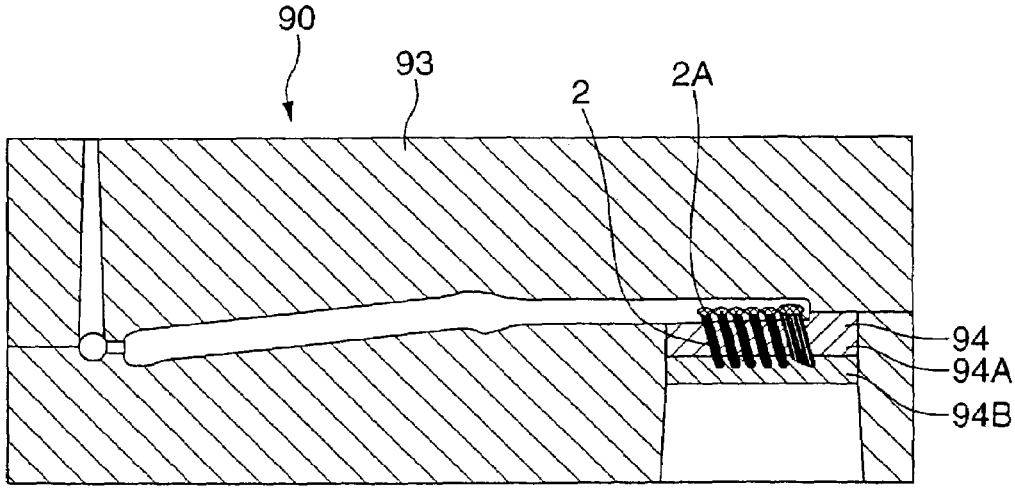

(2) The heating body 81 may use an electric heater, hot air, a laser, ultrasonic vibration, induction heating, or the like. A preferable fusing step for the bristles base portion by the heating body 81 includes heating the bristles base portion by the heating body 81 to form a fused thickness at the end of the bristles, thereafter heat-pressing the fused thickness to form the plate-like block, and thereafter cooling the heat-pressed part. In FIGS. 10 and 16, ultrasonic vibration is employed as the heating body 81. In this case, since the heating body and the pressing body are the same, when the heating body moves from the bristles base portion after cooling the heat-pressed part, the fused resin does not generate strings. As a result, the fused resin is hardly attached to the ultrasonic vibrator, and it is possible to prevent resin deterioration (such as color change) by heating. Preventing resin color change improves commercial value when using transparent plastics for the bristles. An impulse welding machine is also preferable as the heating body 81 because the machine constitutes the same structure as the ultrasonic vibrator (as shown in FIGS. 10 and 16). However, the electric heater, hot air, the laser, ultrasonic vibration, induction heating, or the like mentioned above can be used jointly.

In this case, when the heating body 81 is constituted by ultrasonic vibration, disorder and twisting of the bristles 1 tend to be generated due to vibration. However, the mechanism mentioned in the sliding step inhibits the disorder and twisting of the bristles 2.

(3) In the bristles holding jig 40, an edge of the bristles insertion hole 55 (55A, 55B), which is formed by the upper split body 51 and the middle split body 52, is rounded or beveled as shown in FIG. 9(B), thereby the ultrasonic vibration does not concentrate on a certain spot of the jig 40 and undesirable fusing and bonding of the bristles are prevented. The preferable degree to round or bevel is equal to or more than R0.2 mm.

The charging step of back surface of base plate (FIG. 11) includes:

(1) After fusing the end surface of the base portion in the bristles 2 implanted to the base plate 3 by the bristles base portion fusing apparatus 80, the bristles holding jig 40 is inserted into a charging and molding machine 90. The bristles holding jig 40 is inserted to a positioning portion 92 of the molding machine 90 by an inserting machine 91.

(2) The molding machine 90 contacts a metal mold 93 and the back surface of the base plate 3, and injects the resin into the recess portion of the back surface of the base plate 3. It is sufficient that the metal mold 93 is provided only in the back surface side of the base plate 3, and thereby it is possible to reduce a metal mold cost, and to enable easy maintenance.

(3) The resin 5 is formed from the same resin (for example, polypropylene) as that of the base plate 3. However, it is possible to change physical properties of the base plate 3 and the resin 5 to employ, for example, polypropylene homopolymer or block co-polymer having high rigidity and high impact resistance for the base plate 3 and to employ polypropylene random polymer having a good flowability as resin 5. The high rigidity and the high impact resistance secure a strength of a toothbrush and the good flowability prevents the resin leakage from the bristles setting holes 4 since the charging pressure of the resin can be reduced.

Further, by using a material (for example, an elastomer) as the resin 5, which is different from the base plate 3, it is possible to manufacture a toothbrush having a desired characteristic in elasticity and a desired color appearance.

Figure 12:
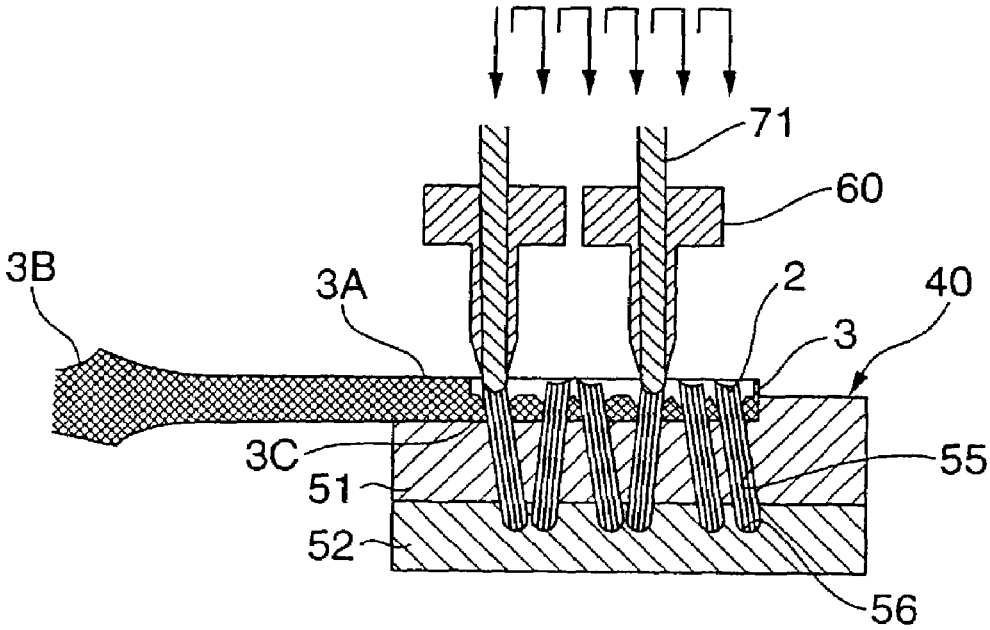
FIG. 12 is a cross sectional view showing another example of the bristles insertion state into a plurality of the bristle insertion holes having different hole axial directions.

Another embodiment of bristles insertion is illustrated in (FIG. 12).

(1) With regard to implanting the bristles 2 to a plurality of the bristles setting holes 4 in the different directions of the base plate 3, it is a most preferable to set the hole axis direction of the sleeve 60 to the same angle so as to align with the hole axial direction of each of the bristles setting holes 4, and to insert the bristles 2.

(2) However, in order to correspond to the each angle of the sleeve 60, a servo motor, a plurality of gears, and a control circuit etc. are required and therefore, the structure of the apparatus becomes complex, and the weight of the apparatus is increased. As a result, operation speeds cannot be made high. In order to resolve these problems, the following structure can be employed.

(3) When the wide opening portion 4A is provided in the bristles setting holes 4 of the base plate 3, the angle at which bristles 2 can be inserted is about ±30 degrees with respect to the vertical direction. By employing the wide opening portion, it is possible to effectively produce the toothbrush having a plurality of different bristle implanting angles with a comparatively simple apparatus structure.

Figure 13:
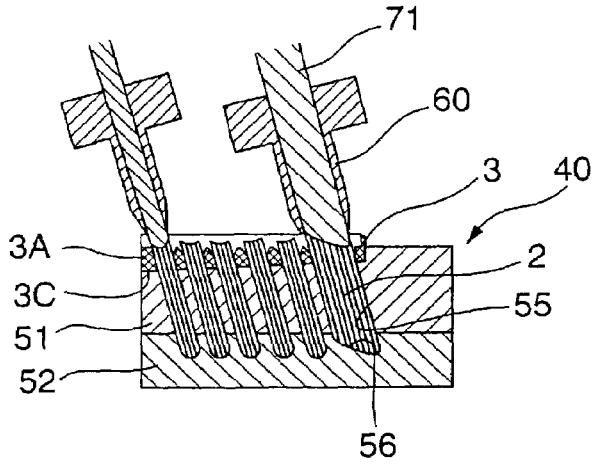
FIGS. 13(A) and 13(B) are views showing a base plate having no grip portion.
Figure 13:
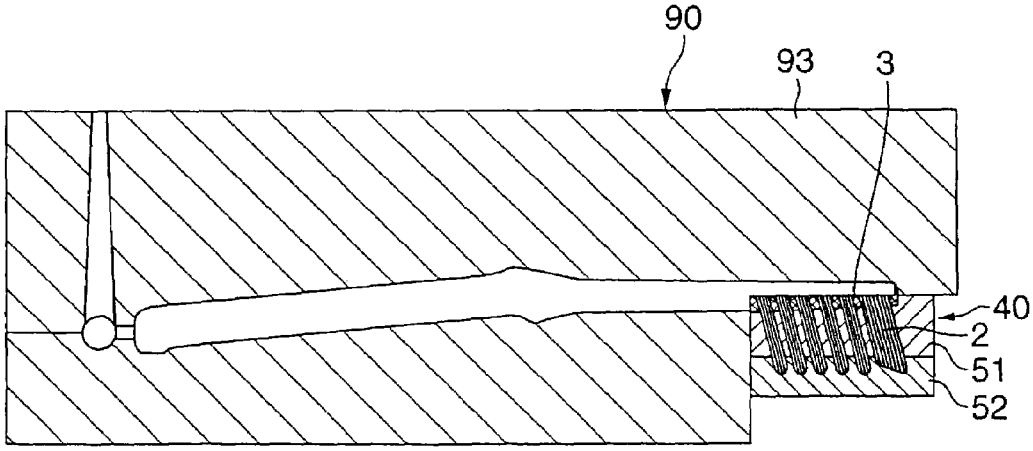
Figure 14:
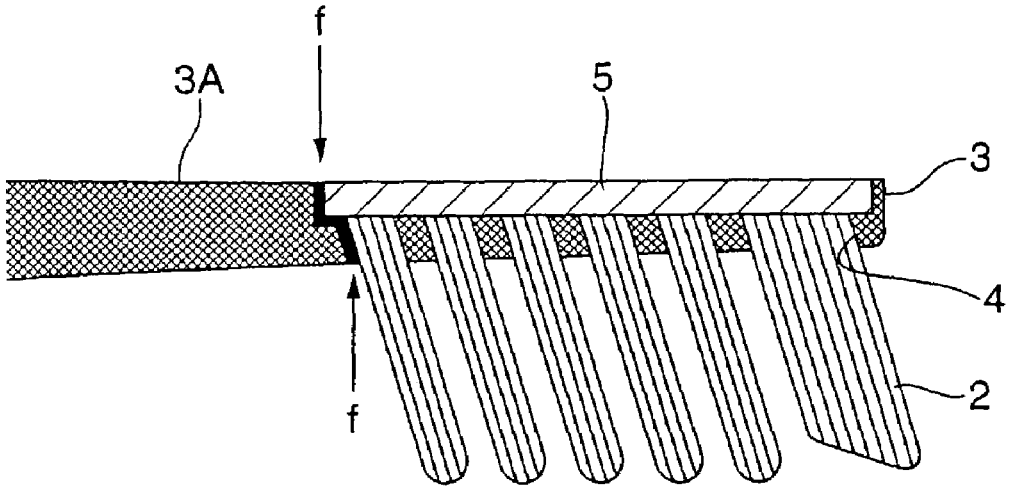
FIGS. 14(A) and 14(B) are views showing a strength evaluation of the base plate.
Figure 14:
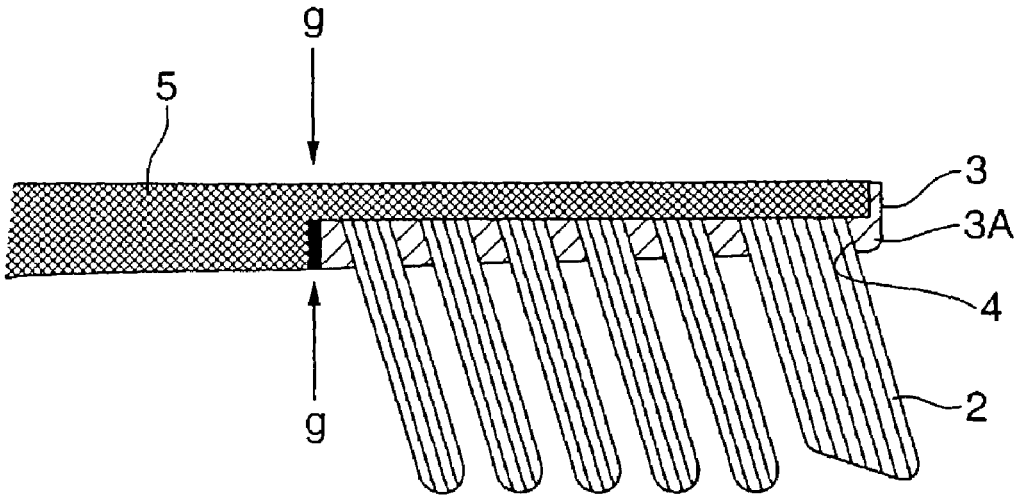

Another example of the base plate is illustrated in (FIGS. 13 and 14).

(1) If the base plate 3 is formed by only a head portion 3A (FIG. 13) and has no other parts such as grip portion 3B (FIG. 12), down-sizing of the apparatus may be achieved in the base plate transfer and the bristles implanting and fixing steps.

(2) The constitution of the base plate 3 affects the strength of a toothbrush. With respect to the base plate 3, which comprises the head portion 3A and the grip portion 3B, the bristles setting hole 4 is continuously connected in two faces between f and f via the end surface of the resin 5 in the back surface recess portion and tends to break (FIG. 14(A)) if the bonding force between the base plate 3 and the back surface charging member 5 becomes weak. By contrast, if the bristles setting hole 4 is not continuously connected in two faces between g and g, strength of the toothbrush is improved (FIG. 14(B)).

Figure 15:
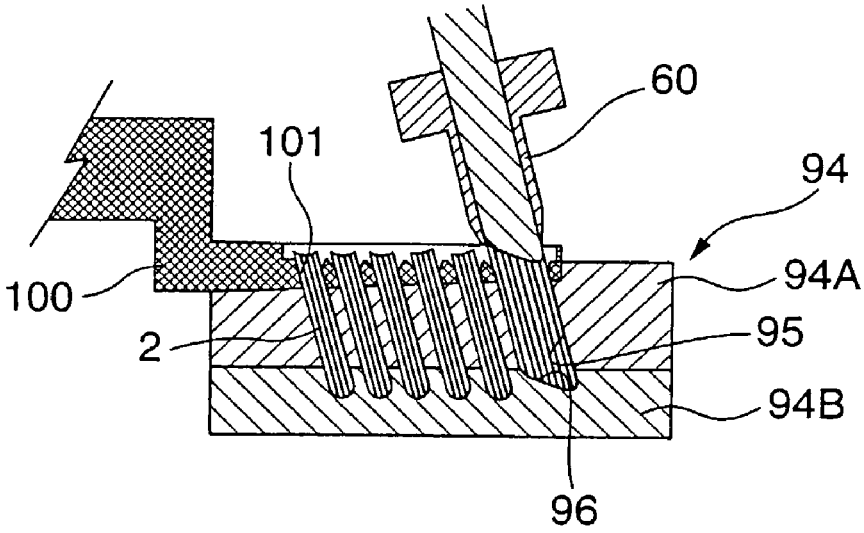
FIGS. 15(A) and 15(B) are views showing a metal mold having bristles insertion holes.
Figure 15:
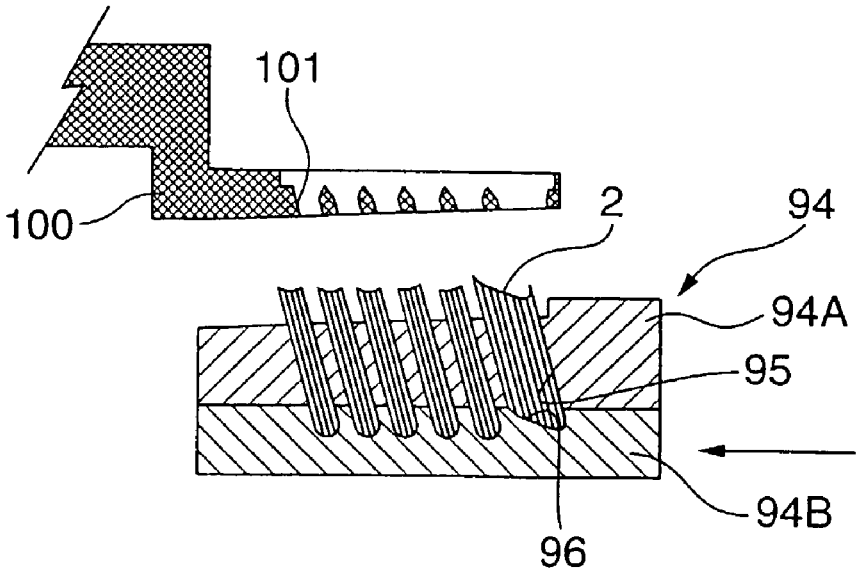

Example of a metal mold having bristles insertion hole is shown by (FIGS. 15 and 16).

The toothbrush can be manufactured by inserting the bristles 2 into the bristles insertion hole 95 provided in a metal mold 94 of the molding machine 90 (FIG. 11) without using the base plate 3.

(1) A guide plate 100 for inserting the bristles is introduced into the metal mold 94, and the extrusion pin 71 pushes the bristles 2 in the sleeve 60 into the bristles hole 95 of the metal mold 94 via the bristles setting holes 101 of the guide plate 100.

The surface of guide plate 100 is coated by polytetrafluoroethylene or the like preferably, whereby even in the case that the sleeve 60 is in contact with the guide plate 100 or the guide plate 100 is in contact with the metal mold 94, it is possible to inhibit them from being damaged. When it is intended to directly introduce the bristles 2 into the bristles insertion hole 95 of the metal mold 94 from the sleeve 60 without using the guide plate 100, the formation of the wide opening for bristles in the bristle insertion hole 95 is difficult.

It is possible to introduce the bristles 2 in the sleeve 60 into the bristles setting holes 101 in a pressure contact state by providing the wide opening portion and it is further possible to insert the bristles into the bristles insertion hole 95 of the metal mold 94 at a high density. Accordingly, it is possible to prevent the charged resin from protruding between the metal mold 94 and the bristles 2.

(2) If the forming hole 96 is provided in the use end of the bristles insertion hole 95 of the metal mold 94, it is possible to stereoscopically form the shape of the use end portion of the bristles 2 when inserting the bristles 2.

(3) When the metal mold 94 is constituted by a plurality of mutually slidable split bodies 94A and 94B, it is possible to slide the split bodies 94A and 94B against each other so as to hold the bristles 2 after inserting the bristles 2 into all of the bristles insertion holes 95 in the metal mold 94, whereby it is possible to prevent disorder of the bristles 2 when the guide plate 100 is removed.

(4) A fused thickness 2A is formed by heating the base portion of the bristles 2 protruding from the bristles insertion hole 95 in the metal mold 94 by the heating body 81 such as the heater, hot air, or the like.

(5) The toothbrush constituted by the head portion provided with the bristles 2 and the grip portion connected thereto can be manufactured by matching the metal mold 94 to the metal mold 93 of the molding machine 90 and integrally forming the resin around the fused thickness in the base portion of the bristles 2.

When manufacturing the toothbrush using the toothbrush manufacturing apparatus 10, the following modifications can be employed.

(1) The number of sleeves is not limited to one, but two or more sleeves may be employed. For example, two parallel sleeves may be simultaneously inserted with respect to the bristles insertion holes having the same diameters.

(2) The hole cross section of the sleeve may be set to a shape other than the round shape.

(3) The hole cross section of the sleeve may be set to a similar shape as that of the bristles insertion hole.

(4) The hole cross sectional shape of the bristles holding jig is not always limited to the same shape as the hole cross section of the base plate.

(5) When plural stacks 30 are employed, it is possible to implant bristles having different lengths using the same sleeve, provided that different lengths of the bristles are supplied to the respective stacks 30.

(6) An adhesive may be applied to the back surface resin charging portion.

(7) It is possible to employ a method of picking the bristles of predetermined length from the stack 30 using various systems, and to insert the bristles from a rear end of the sleeve and to implant them using the extrusion pin.

(8) It is possible to employ a method of setting a predetermined amount of the bristles in a spool and to implant them using the extrusion pin (including both cutting the bristles before inserting into the sleeve and cutting after inserting).

According to the present invention, the following effects can be obtained.

(1) Since the sleeve 60 is individually provided for each of the bristles insertion holes 55, it is possible to implant the bristles 2 in the bristles setting holes of different cross sectional shapes and areas, and it is possible to implant the bristles 2 in various implanting directions (implanting angles).

(2) Since the bristles 2 are inserted into the bristles insertion hole 55 with the guide of the sleeve 60, it is possible to implant the bristles into the bristles insertion hole 55 at a high charging density, and it is possible to inhibit leakage of charged resin 5 from the bristles insertion hole 55.

(3) Since the bristles 2 are extruded from the individual sleeve 60, it is possible to individually position the bristles 2 at each of the bristles insertion holes 55 (as compared with the implanting method described in Japanese Patent Application Laid-Open No. 9-182632), a fine adjustment at a time of inserting into the bristles insertion hole 55 can be attained, and insertion accuracy is improved. The structure of the present invention is suitable for production of the toothbrush in which various functions are required. Further, in the case of using the predetermined length of bristles, the inserting apparatus for the bristles can be made compact in comparison with the spool type.

(4) The bristles 2 in the sleeve 60 are inserted into the bristles insertion hole 55 via the bristles setting hole 4 of the base plate 3. In this case, a close contact between the sleeve 60 and the bristles setting hole 4 of the base plate 3 is attainable since the base plate 3 made of the resin is soft and the sleeve 60 and the base plate 3 both do not sustain damages at the close contact. It is easy to extrude the bristles 2 and to increase the charging density due to the close contact.

(5) It is possible to inhibit leakage of charging resin 5 from the bristles setting hole 4 of the base plate 3.

(6) Since the wide opening portion 4A in the bristles setting hole 4 of the base plate 3 serves as the insertion guide for the bristles 2 extruded from the sleeve 60, it is possible to insert the bristles 2 with increased charging density into the bristles insertion hole 55. A yield of inserting the bristles is good, it is possible to increase the insertion density of the bristles, and it is possible to further inhibit the charged resin 5 from leakage from the bristles insertion hole.

(7) The bristles 2 are sometimes obliquely implanted to the base plate 3 in order to provide an improved plaque removing function in the toothbrush and to make the top of the bristles reach the interdental portion. According to the present invention, oblique implanting can be easily achieved. It is possible to implant the bristles 2 by inserting all or a part of the bristles 2 at an optional direction.

(8) It is possible to make the structure of the apparatus simple in comparison with the case of using the spool by providing the wide opening portion 4 on the back surface of the base plate 3 and inserting the bristles 2 from the back surface.

(9) The shape of the use end of the bristles 2 be optionally formed even if different lengths of bristles are employed for implanting, according to the cooperation effect of the forming end 73 in the use end of the extrusion pin 71 and the forming hole 56 of the bristles insertion hole 55.

(10) In the structure in which the bristles end is formed by the bidirectional pin described in Japanese Patent Application Laid-Open No. 7-194433, the plunger is required and the structure of the apparatus becomes complex. On the contrary, according to the present invention, the structure of the apparatus can be made simple.

(11) In order to enable the cleaning function (the plaque removing function, the function of making the top of the bristle reach the portion between the teeth) to the toothbrush, oblique implanting of the bristles 2 is sometimes practiced. The present invention enables easy oblique implanting. It is possible to obliquely implant by inserting all or a part of the bristles 2 in the same direction or in a plurality of different directions.

(12) It is possible to perform a complex bristles implanting pattern in which the bristles 2 obliquely intersect each other by use of a compact sleeve 60. In the case of the system in which the bristles are reeled out from the spool, it is hard to obliquely intersect the bristles.

(13) Even if the bristles insertion hole 55 is oblique, it is possible to insert the bristles from the sleeve 60 in one direction. It is also possible to insert the bristles easily and smoothly into the oblique bristles insertion hole 55 owing to the wide opening portion 4A provided in the bristles setting hole 4.

(14) When the directions of hole axes of each individual bristles insertion hole 55 are not the same, the conventional known apparatus sets the positioning of the respective sleeves 60 to the hole axial directions of the bristles insertion holes 55, and the mechanism becomes more complex, since the apparatus is equipped with a servo motor, gears, and the like. Further, the conventional known apparatus is heavy and has low performance with regard to the inserting speed and the inserting accuracy. By contrast, the apparatus of the present invention has simple structure and high performance, since insertion with the sleeve 60 from one direction is achieved to a plurality of bristles insertion holes 55 having the different hole axial directions.

(15) It is possible to fasten and fix the bristles 2 using the bristles holding jig 40 after inserting the bristles 2 into the bristles insertion hole 55. Accordingly, it is possible to securely hold the bristles 2 without disorder of the bristles at stages of removal of the sleeve 60 and the pin 71 after bristles insertion into the bristles setting holes and during of transferring step, fusing step, and resin charging step.

(16) Since the base plate 3 has only the head portion 3A and has no grip portion 3B, it is possible to delete a cumbersome transfer procedure of the base plate 3.

INDUSTRIAL APPLICABILITY

As mentioned above, according to the present invention, it is possible to optionally set the implanting angle of the bristles with the simple apparatus structure and prevent leakage of the resin from the bristles setting holes by inserting the bristles into the bristles insertion hole at a high density, in the bristles implanting methods using no anchoring metal plate.

Further, according to the present invention, it is possible to optionally form the shape of the use end of the bristles.

What is claimed is:

1. A method of manufacturing a brush, the method comprising:

inserting bristles into a plurality of bristles insertion holes;

implanting the bristles in a resin material, wherein the inserting further comprises preparing a plurality of sleeves corresponding to a plurality of cross sectional shapes and cross sectional areas of the plurality of bristles insertion holes, introducing the bristles into the plurality of sleeves, and inserting the bristles within each sleeve of the plurality of sleeves into the corresponding bristles insertion holes, and extruding the use end of the bristles to form a desired shape at a time of inserting the bristles within at least one sleeve into at least one bristles insertion hole by pushing the bristles out from the at least one sleeve with at least one extrusion pin.

2. The manufacturing method as claimed in claim 1, wherein the bristles within at least one of the plurality of sleeves are inserted into at least one of the plurality of bristles insertion holes via a bristles setting hole previously formed on a base plate.

3. The manufacturing method as claimed in claim 2, further comprising:

providing a forming hole in at least one bristles insertion hole for forming a use end shape of the bristles.

4. The manufacturing method as claimed in claim 2, further comprising inserting the bristles into the plurality of bristles insertion holes to obliquely implant the bristles into an implanting surface of the resin material.

5. The manufacturing method as claimed in claim 2, wherein:

at least one of the plurality of the bristles insertion holes is arranged to obliquely intersect a hole axis of a corresponding sleeve; and the bristles within the corresponding sleeve are inserted from the opening portion of the bristles setting hole into the at least one bristles insertion hole.

6. The manufacturing method as claimed in claim 2, further comprising providing a base plate including a portion having the bristles setting hole without a grip portion.

7. The manufacturing method as claimed in claim 1, wherein the bristles insertion holes are disposed in a holding jig and the bristles are inserted from the plurality of sleeves through a head portion of the brush and then into the bristles insertion holes.

8. The manufacturing method as claimed in claim 1, wherein the pushing includes moving the ends of the bristles relative to one-another into a shape conforming to a shape of an end of the extrusion pin and complimentary in shape to a forming hole located at a bottom of the at least one bristles insertion hole.

9. A method of manufacturing a brush, the method comprising:

inserting bristles into a plurality of bristles insertion holes; and implanting the bristles in a resin material, wherein the inserting further comprises preparing a plurality of sleeves corresponding to a plurality of cross sectional shapes and cross sectional areas of the plurality of bristles insertion holes, introducing the bristles into the plurality of sleeves, and inserting the bristles within each sleeve of the plurality of sleeves into the corresponding bristles insertion holes by pushing the bristles out from the sleeves with at least one extrusion pin, wherein the bristles within at least one of the plurality of sleeves are inserted into at least one of the plurality of bristles insertion holes via a bristles setting hole previously formed on a base plate, wherein the bristles setting hole is provided with an opening portion having a diameter wider than a diameter of at least one portion of the bristles setting hole of the base plate; and provided with at least one portion having a diameter smaller than a diameter of the sleeve, into which the bristles are inserted.

10. The manufacturing method as claimed in claim 9, wherein the pushing includes moving the ends of the bristles relative to one-another into a shape conforming to a shape of an end of the extrusion pin and complimentary in shape to a forming hole located at a bottom of the at least one bristles insertion hole.

11. A method of manufacturing a brush, the method comprising:

inserting bristles into a plurality of bristles insertion holes; and implanting the bristles in a resin material, wherein the inserting further comprises preparing a plurality of sleeves corresponding to a plurality of cross sectional shapes and cross sectional areas of the plurality of bristles insertion holes, introducing the bristles into the plurality of sleeves, and inserting the bristles within each sleeve of the plurality of sleeves into the corresponding bristles insertion holes, wherein the bristles within at least one of the plurality of sleeves are inserted into at least one of the plurality of bristles insertion holes via a bristles setting hole previously formed on a base plate, wherein:

at least one of the plurality of the bristles insertion holes extends from a first part of a metal mold or a bristles holding jig to a second part of the metal mold or the bristles holding jig in a hole axis direction of the at least one bristles insertion hole; and the metal mold or bristles holding jig is configured to fix the bristles by sliding of the second part of the metal mold or the bristles holding jig in a direction non-parallel to the hole axis after inserting the bristles into the bristles insertion hole.

12. A method of manufacturing a brush, the method comprising:

inserting bristles into a plurality of bristles insertion holes;

implanting the bristles in a resin material, wherein the inserting further comprises preparing a plurality of sleeves corresponding to a plurality of cross sectional shapes and cross sectional areas of the plurality of bristles insertion holes, introducing the bristles into the plurality of sleeves, and inserting the bristles within each sleeve of the plurality of sleeves into the corresponding bristles insertion holes, and extruding the use end of the bristles to form a desired shape at a time of inserting the bristles within at least one sleeve into the at least one bristles insertion hole, wherein the bristles insertion holes are disposed in a metal mold and the bristles are inserted from the plurality of sleeves through an area of the metal mold which will mold the head portion of the brush and then into the bristles insertion holes.

* * * * *